United States Patent [19]

Nakai et al.

[11] 4,234,262

[45] Nov. 18, 1980

[54] SINGLE ELEMENT PRINT HEAD

[75] Inventors: Toshio Nakai; Susumu Kuzuya; Akira Asai; Takayuki Iwase; Hiroshi Onoda; Kazuo Nakamura, all of Nagoya, Japan

[73] Assignee: Brother Kogyo Kabushiki Kaisha, Nagoya, Japan

[21] Appl. No.: 26,676

[22] Filed: Apr. 3, 1979

[30] Foreign Application Priority Data

Apr. 28, 1978 [JP] Japan ..... 53/58721

[51] Int. Cl.[3] ..... B41J 1/60

[52] U.S. Cl. ..... 400/175; 403/328; 285/305

[58] Field of Search ..... 403/328; 285/305; 400/174, 175, 463, 469

[56] References Cited

U.S. PATENT DOCUMENTS

| | | | |
|---|---|---|---|
| 825,968 | 7/1906 | Hammond | 400/174 |
| 1,019,000 | 2/1912 | Watson | 285/305 |
| 1,513,710 | 10/1924 | Lewis | 285/305 |
| 2,444,979 | 7/1948 | Conrad et al. | 403/328 |
| 2,979,354 | 4/1961 | Vaughn et al. | 403/328 |
| 3,001,628 | 9/1961 | Rice, Jr. | 400/175 |
| 3,027,988 | 4/1962 | Tackett | 400/175 |
| 3,307,677 | 3/1967 | Frank et al. | 400/175 |
| 3,658,162 | 4/1972 | Van der Werff | 400/175 |
| 3,753,582 | 8/1973 | Graham | 285/305 |
| 4,064,984 | 12/1977 | Toeppen | 400/175 |

*Primary Examiner*—William Pieprz

*Attorney, Agent, or Firm*—Browdy and Neimark

[57] ABSTRACT

A single element print head having an apparatus for firmly and releasably attaching itself to the drive shaft of a typewriter. The body of the print head is provided with a central opening therethrough for receipt of the drive shaft. A cap is secured on the body around one end of the opening with the purpose of slidably holding a manual slide member in its guide recess and fixedly holding a base portion of a hair pin shaped spring in its holding groove. The spring has a pair of arms for firmly fastening therebetween, and for releasing the drive shaft by virtue of its resilience and the action of a pair of cam surfaces. The pair of cam surfaces are formed in the bottom portion of the slide member, diverging from one end to the other end like a front portion of a bullet, for expanding the arms from each other to release the arms from the drive shaft by means of the slide movement of the slide member.

4 Claims, 5 Drawing Figures

SINGLE ELEMENT PRINT HEAD

BACKGROUND OF THE INVENTION

1. Field of the Invention

This invention relates to a single element print head of a typewriter and more particularly to a single element print head having an apparatus for releasably attaching it to a drive shaft.

2. Description of the Prior Art

In a single element print head typewriter, as is shown in U.S. Pat. No. 2,895,584, characters and symbols arranged on the print head surface are properly chosen by a print head driving member and are printed on paper, in which the selection of print style can be made easily by changing the print head. In order to change the print head easily it is necessary to provide any convenient means releasably attaching the print head to a drive section, and this means itself should be easy in handling. To this end, various releasable attaching means such as those disclosed in U.S. Pat. Nos. 3,001,628 and 3,307,677 have been practically applied. This kind of attaching means is desired to be one which can be easily handled manually and which affords a sufficient coupling force to transmit the motion of the print-head-driving-section positively to the print head.

Object of the Invention

It is the object of this invention to provide an improved single element print head having an apparatus for releasably attaching the print head to a drive shaft, which apparatus possesses a superior manual handling feature and a positive coupling force.

DETAILED DESCRIPTION OF THE PREFERRED EMBODIMENT

Figure 1:
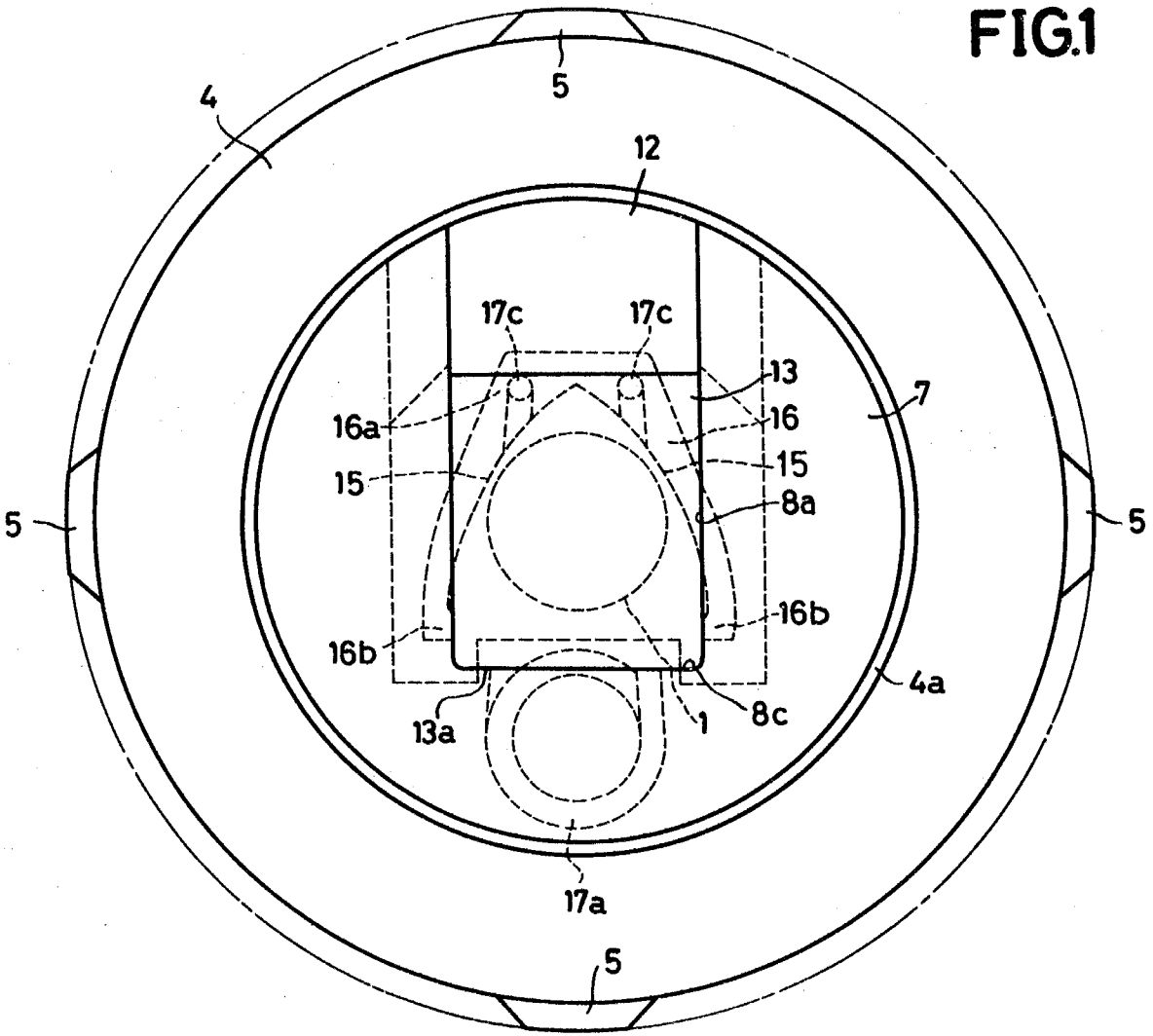
FIG. 1 is an enlarged plan view showing the condition in which a print head drive shaft and a print head have been mounted according to this invention.
Figure 5:
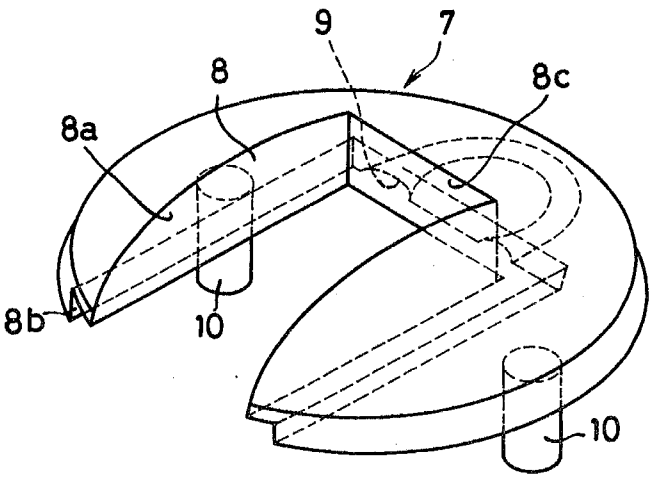
FIG. 5 is an enlarged perspective view of the cap.
Figure 4:
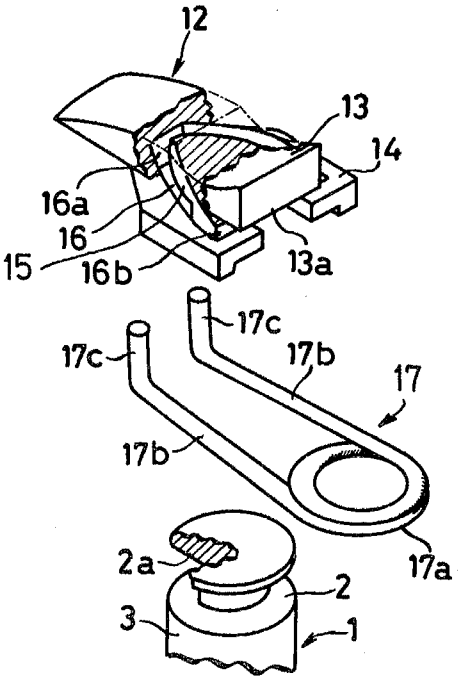
FIG. 4 is an exploded perspective view illustrating the slide member, the spring and the print head drive sahft on an enlarged scale.

Referring to FIG. 1, which is an enlarged plan view of a print head releasably mounted by utilization of the attaching means of this invention, the reference numeral 1 designates a print head drive shaft which is disposed on the carriage (not shown) in the typewriter body (not shown) and constitutes a part of a print head drive section. In the upper end portion of the print head drive shaft 1, as is shown in FIG. 4, is formed a grooved portion 2, under which is formed a mounting portion 3. A tapered slant face 2*a* is formed extending from the grooved portion 2 to the upper end of the print head drive shaft 1. A print head body 4 is formed of a truncated spherical shell having a plane upper wall and also having an outer peripheral surface on which are embossed a number of characters 5 (only a part of which are shown). In the central part of the print head body 4 is formed a through opening 6 extending through the upper wall thereof, into which is fitted the print head drive shaft 1 so that its grooved portion 2 projects upward from an upper end surface 4*a* of the print head, while at the same time a projection (not shown) formed on the mounting portion 3 engages a notch (not shown) formed in the lower part of the through opening 6 on its inner peripheral surface, whereby the print head body 4 and the print head drive shaft 1 are mounted together so as to be rotatable in a body. Consequently, the print head body 4 rotates with the rotation of the print head drive shaft 1 and performs a character selecting operation. A cap 7 is secured to the upper end surface 4*a* of the print head body 4. In the central portion of the cap 7, as is shown in FIG. 5, there is formed therethrough a guide portion 8 one end of which is open at the outer peripheral part, and on the bottom surface of the cap 7 is formed a generally annular holding groove 9. The guide portion 8 is composed of a first upper guide groove 8*a* and a second lower guide groove 8*b* of larger width, the first and second guide grooves 8*a*, 8*b* being stepped to each other. Formed on the bottom surface of the cap 7 are pins 10 adapted to fit in caulking holes 11 formed in the upper end surface 4*a* of the print head body 4. The pins 10 are used to couple the print head 4 with the cap 7 after going through the subsequent caulking process.

Figure 2:
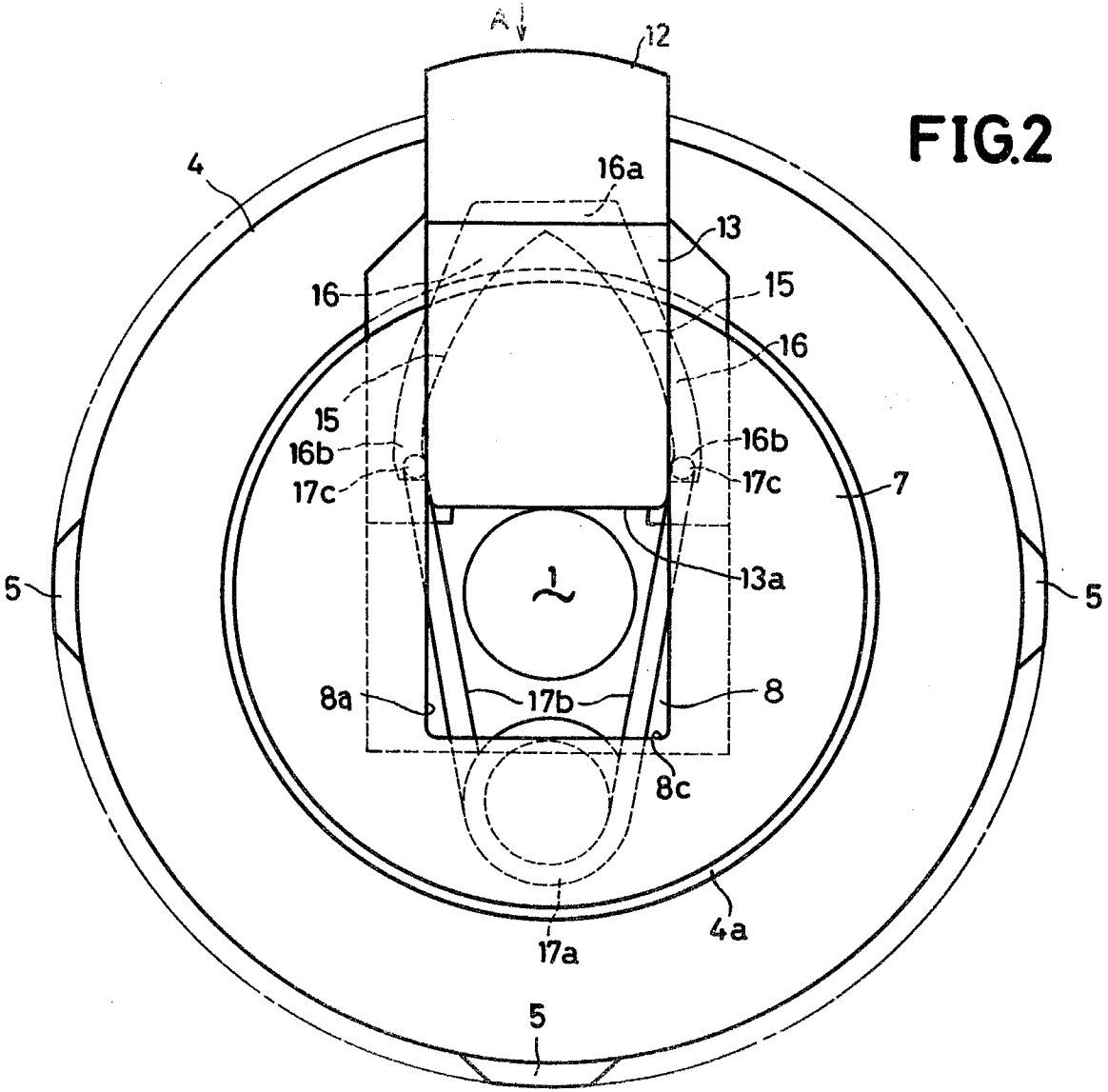
FIG. 2 is an enlarged plan view showing the condition in which a slide member has been moved from the state illustrated in FIG. 1.

As illustrated in FIG. 4, a slide member 12 is provided at its upper portion with an operating portion 13 of about the same width as the first guide groove 8*a* and further provided at its lower portion with a guided portion 14 of about the same width and height as the second guide groove 8*b*. In the guided portion 14 is formed a guide passage 16 so that there is formed a cam means, which consists of a pair of cam surfaces 15 gradually diverging from the mutually nearest portion towards the mutually farthest portion, forming a shape of substantially a longitudinal section of a bullet, since the rate of diverging decreases as the diverging advances. Each of the cam surfaces has a recess in adjacent to its farthest portion. The slide member 12 is mounted so as to allow the operating portion 13 and the guided portion 14 to be guided by the first and second guide grooves 8*a*, 8*b* in the cap 7 respectively, and to allow the bottom surface of the guided portion 14 to slide along the upper end surface 4*a*. In other words, as a result of the cap 7 being secured with pins 10 to the upper end surface 4*a*, the slide member 12 is carried between the cap 7 and the upper end surface 4*a* so as to be movable along the first and second guide grooves 8*a*, 8*b* and the upper end surface 4*a*, so that the slide member 12 can slide between a first operating position in which, as illustrated in FIG. 1, an end face 13*a* of the operating portion 13 abuts an end face 8*c* of the guide portion 8 of the cap 7 and a second operating position in which, as illustrated in FIG. 2, the manual slide member 12 has been pulled out of the guide portion 8 to the fullest extent so that the arms of the spring 17 have been most widely opened.

A spring 17 is generally U-shaped or hair pin-shaped, having a base portion 17*a* of a loop shape capable of fitting in the holding groove 9, a pair of arms 17*b* extended in the same direction from the base portion 17*a*, and a bent end 17*c* formed at the free end of each arm 17*b*. The spring 17 has a resilience sufficient to permit both bent ends 17*c* to approach to each other, and it is mounted so that, after the slide member 12 has been inserted as above in the guide portion 8 of the cap 7, the base portion 17*a* of the spring 17 engages with, for being held in, the holding groove 9 of the cap 7, and the bent ends 17*c* are positioned within the guide passage 16. Thus the cap 7, which has been attached the slide member 12 and the spring 17, is fixed to the upper end surface 4*a* of the print head body 4 by means of caulking of the pins 10 got through the caulking holes 11, whereby the spring 17 is held between the cap 7 and the upper end surface 4*a*, and the slide member 12 is carried so as to be slidably guided by the upper end surface 4*a* and the guide portion 8.

Figure 3:
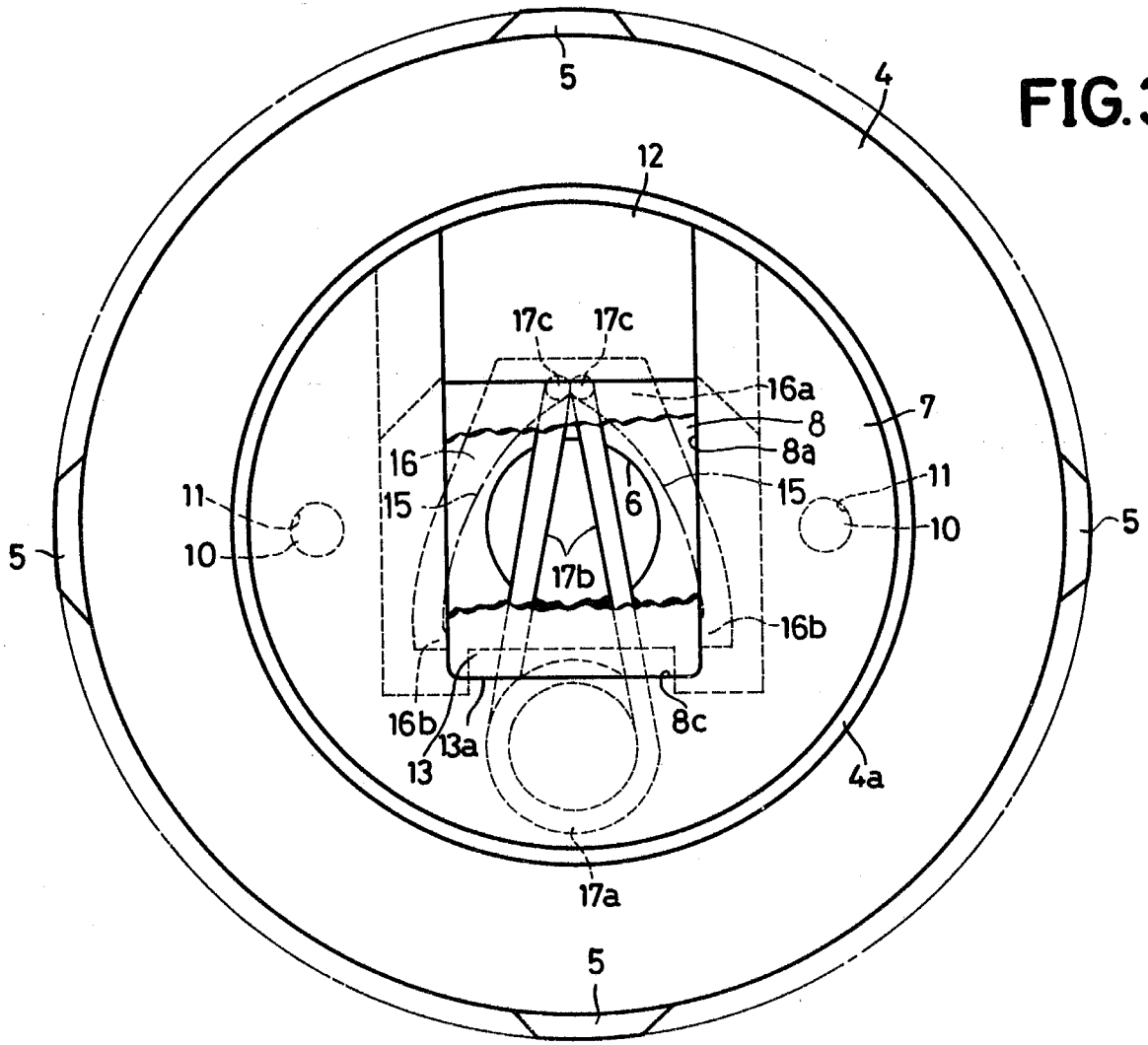
FIG. 3 is an enlarged plan view showing the condition in which a cap, the slide member and a spring have been arranged on the print head.

When the slide member 12 is located in the first operating position as illustrated in FIG. 3, the arms 17*b* of the spring 17 extend over, and at the same time cross through the area of, the through opening 6 of the print head body 4 and the bent ends 17*c* are positioned in a front portion 16*a* of the guide passage 16, thus assuming the most closely approached state of the bent ends 17*c*. On the other hand, when the slide member 12 moves to the second operating position as shown in FIG. 2, the bent ends 17*c* of the spring 17 are moved along the cam surfaces 15, thus allowing the arms 17*b* to pass over, at the same time outside the area of, the through opening 6 of the print head body 4 until the bent ends 17*c* are rested in positioning recesses 16*b* of the guide passage 16 to assume the most widely open state of the beat ends 17*c*.

The following description is now provided for explaining how to attach and detach the print head, which has been assembled to a unit body including the print head body 4, the cap 7, the slide member 12 and the spring 17 put respectively in place, to and from the print head drive shaft 1.

First, the slide member 12 is moved to the second operating position as illustrated in FIG. 2 so that, as mentioned above, the arms 17*b* of the spring 17 pass outside the area of the through opening 6. This condition is maintained by engagement of the bent ends 17*c* of the spring 17 with the positioning recesses 16*b* of the guide passage 16 unless a force acting in the direction of arrow A is exerted on the slide member 12. In this condition, when the print head drive shaft 1 is inserted in the through opening 6 of the print head body 4 and a positional relationship of both is fixed by the afore-mentioned notch and projection (not shown), the grooved portion 2 of the print head drive shaft 1 projects upward from the upper end surface 4*a* and is positioned within the travelling locus of the arms 17*b* of the spring 17. Therefore, when the slide member 12 is returned to the first operating position as illustrated in FIG. 1, the spring 17 begins to change the form or posture, by virtue of its own resilience, along the contour of the cam surfaces 15 in such a manner that both arms 17*b* approach each other, and its changing of posture continues until the arms 17*b* come into pressure-engagement with the grooved portion 2 of the print head drive shaft 1. By the pressure-engagement of both arms 17*b* of the spring 17 with the grooved portion 2 of the print head drive shaft 1, the print head body 4 is fixed firm enough so as not to come off the print head drive shaft 1. In this way, the attaching operation of the print head to the print head drive shaft 1 is completed.

To detach the print head from the print head drive shaft 1, the slide member 12 is moved to the second operating position as illustrated in FIG. 2 whereby the arms 17*b* of the spring 17 are expanded by the action of the cam surfaces 15 to be disengaged from the grooved portion 2 of the print head drive shaft 1, that is, they assume the state shown in FIG. 2. Thus, the fixed state between the print head drive shaft 1 and the print head is released, thereby permitting the latter to be removed from the former.

According to the present invention, as set forth hereinbefore, the print head can be mounted and removed simply due to the easy manual movement of the slide member. In addition, the apparatus of the present invention is so simple in structure that its assembling manipulation is very easy.

What is claimed is:

1. In a single print element head releasably attached to a drive shaft, the improvement wherein said print head comprises:

a print head body having a central openind therethrough for receipt of the drive shaft and characters formed on the periphery thereof;

a cap secured on said print head body around one end of said opening;

a manual slide member held by said cap so as to be slidable in a perpendicular direction to the axis of the drive shaft, between a first and a second positions, said manual slide member having a cam means in the bottom portion thereof, said cam means consisting of a pair of cam surfaces which gradually diverge, from the mutually nearest portion towards the mutually farthest portion, each of said cam surfaces having a recess therein adjacent to its said farthest portion; and a spring disposed in a space formed between said cap and said body, said spring having a pair of arms adapted to move between an open position for releasing said print head body from the drive shaft and a closed position for fastening said print head body to the drive shaft, each of said arms having a free end contacting respectively with each of other cam surfaces each said free end being rested in a respective one of said recesses when said manual slide member is in said second position, said arms being moved from said open position to said closed position when said manual slide member is moved from said second position to said first position and wherein said spring is formed in a hair pin like shape and consists of a base portion and said pair of arms extending from said base portion, each of said arms being bent at its free end so as to be contacted with each of said cam surfaces respectively.

2. The print head as in claim 1 wherein said base portion of said spring is of loop shape.

3. The print head as in claim 1 wherein said cap has a hold portion for fixedly holding said base portion of said spring in said space formed between said cap and said body, and a guide portion for slidably holding said manual slide member.

4. The print head as in claim 1 wherein the rate of diverging of said pair of cam surfaces gradually decreases as the diverging advances.

* * * * *